United States Patent [19]

Kurz

[11] 4,044,576

[45] Aug. 30, 1977

[54] WARP-KNITTED FABRICS

[76] Inventor: Milton Kurz, Pond Crossing, Lawrence, N.Y. 11559

[21] Appl. No.: 629,851

[22] Filed: Nov. 7, 1975

[51] Int. Cl.[2] ..... D04B 23/08; D04B 23/10

[52] U.S. Cl. ..... 66/193

[58] Field of Search ..... 66/190, 192, 193, 195

[56] References Cited

FOREIGN PATENT DOCUMENTS

| | | | |
|---|---|---|---|
| 1,108,458 | 1/1956 | France | 66/195 |
| 1,236,119 | 3/1967 | Germany | 66/193 |
| 1,063,317 | 8/1959 | Germany | 66/193 |
| 1,088,742 | 10/1957 | United Kingdom | 66/193 |

OTHER PUBLICATIONS

Wheatley, B., "Raschel Lace Production", 1972, N.Y., Nat. Knitted Outerwear Assoc., pp. 60–62.

*Primary Examiner*—Ronald Feldbaum

*Attorney, Agent, or Firm*—Brumbaugh, Graves, Donohue & Raymond

[57] ABSTRACT

A warp-knitted fabric comprises one set of threads forming a multiplicity of inerconnected, contracted loop and two sets of laid-in threads arranged in pairs. Each of the threads of the pairs of lay-ins includes in each repeat of a knitting pattern at least two short lay-ins between wales and at least two long lay-ins between wales, there being for each long lay-in between wales of each thread of each pair a corresponding short lay-in between wales of the other thread of the pair which is located in the same course as and extends in the opposite direction from the said long lay-in between wales. The threads of each pair of laid-in threads form mirror images of each other which are offset from each other by at least two courses and are thus of substantially equal total lengths in each repeat. Each laid-in thread may also include in each repeat at least two lay-ins in a wale, there being for each lay-in in a wale of one of the threads of each pair a corresponding lay-in in a wale of the other thread of the pair located in the same courses.

4 Claims, 4 Drawing Figures

WARP-KNITTED FABRICS

BACKGROUND OF THE INVENTION

Many well-known warp-knitted fabrics are made on knitting machines that have three or more guide bars, at least two of which incorporate threads into the fabric as lay-ins in the chain network. A third guide bar, and perhaps additional guide bars, deliver a third set, or additional sets, of threads to the needles to form the chain stitching.

In warp-knitted fabrics in which two or more guide bars deliver lay-ins exclusively and one or more guide bars deliver threads that are knitted into warp-wise chains, there are many known examples in which one of the sets of laid-in threads from one guide bar is dominant and the other set is recessive. For example, a known open-mesh fabric made on Rachel machines involves forming warp-wise chains from threads delivered by the front guide bar set up on the formula, 02/20, and two sets of lay-ins are delivered by two additional guide bars, as follows:

Guide Bar II, 00/22/00/66/44/66;

Guide Bar III, 44/22/44/00/22/00.

Of the two sets of lay-ins in that fabric, the set delivered by guide bar II is dominant or aggressive, and the set delivererd by guide bar III is recessive, inasmuch as between the third and fourth courses, the threads delivered by guide bar II, which moves 00/66, extend across three wales in one direction while the threads from guide bar III, which moves 44/00, extend across two wales in the opposite direction and then between the sixth and first courses, the threads from guide bar II (66/00) lay in from the third to the first wale while the threads from guide bar III (00/44) lay in from the second to the third wale.

It is apparent that the yarn consumption in fabrics of the types described above, as between the dominant and recessive elements of the fabrics, is unequal, the dominant or aggressive elements requiring substantially more thread than the recessive elements. As far as the knitter is concerned, this means either special machine set-ups with different size yarn packages established to run out at about the same time, a solution that is of little practical value, or more downtime on the machine for rethreading and the production of relatively shorter lengths of fabric per run between rethreadings. Machine downtime is, of course, a cost factor in the total knitting operation, and minimizing downtime for rethreading increases efficiency and reduces unit costs.

The existence of aggressive and recessive elements in warp-knitted fabrics also affects the overall strength of the fabric by causing uneven stresses in the threads, depending upon whether such threads are aggressive or recessive; the recessive elements of the fabrics tend to be stressed higher than the aggressive elements under a given load, and it is therefore the recessive elements that break first and govern the overall strength..

The disadvantages of unbalanced fabric construction in warp-knitting from the point of view of increased downtime in the machine for rethreading and the desirability of balancing yarn consumption among the guide bars has been recognized in the past. See, for example, Kurz U.S. Pat. No. 3,447,345 granted June 3, 1969. The affect of the presence of aggressive and recessive elements in knit fabrics on the fabric strength has perhaps been recognized by other, but there has heretofore been no known practical way of increasing the strength without at the same time decreasing the stability of fabrics of the type here involved.

SUMMARY OF THE INVENTION

The present invention involves a concept or principle that permits substantial equalization of rates of thread use in fabrics that inherently embody both aggressive and recessive elements as lay-ins and increases the strength and tenacity of the fabric without impairing the stability. More particularly, the invention involves, first, making each set of laid-in elements alternately aggressive and recessive in a reasonably close area or in reasonable proximity; in other words, each set of laid-in threads includes relatively aggressive segments and relatively recessive segments in close proximity. Second, the invention involves matching the aggressive segments of one set of threads by recessive segments of the other set of threads and vice versa.

In the above discussion, the terms "aggressive" and "recessive" have been adopted and used because they reflect quite clearly the nature of the guide bar movements that produce the fabric construction. A simpler and more conventional way of describing the fabric construction is to use the term "long lay-in between wales" to refer to a thread segment that is laid in coursewise across a relatively greater numer of wales and the term "short lay-in between wales" to refer to a thread segment that is laid in coursewise across a relatively lesser number of wales. The termns "long" and "short" as used herein, are relative terms and refer to the relative number of wales which two lay-ins in question cross; thus, short lay-in may cross between adjacent wales or may extend across several wales, and likewise a long lay-in may extend across two or more wales. However, in referring to any particular fabric construction and, specifically, to a particular course in the fabric, a long lay-in between wales will extend across a greater number of wales than does a short-lay-in between wales, as those terms are used herein.

A warp-knitted fabric, according to the present invention, comprises one set of threads forming a multiplicity of interconnected, contracted loops and two sets of laid-in threads arranged in pairs. Each of the threads of the pairs of lay-ins includes in each repeat of a knitting pattern at least two short lay-ins between wales and at least two long lay-ins between wales, there being for each long lay-in between wales of each thread of each pair a corresponding short lay-in between wales of the other thread of the pair which is located in the same course as and extends in the oppostie direction from the said long lay-in between wales. The threads of each pair of laid-in threads form mirror images of each other which are offset from each other by at least two courses. Each laid-in thread may also include in each repeat at least two lay-ins in a wale, there being for each lay-in in a wale of one of the threads of each pair a corresponding lay-in in a wale of the other thread of the pair located in the same courses.

By providing both long and short lay-ins between wales in each thread of the pair of laid-in threads, the total yarn consumption of the two sets of threads making up the pairs is essentially equal, thereby minimizing machine downtime for rethreading and reducing costs per unit of manufacture. Similarly, the alternation between long and short lay-ins between wales in each thread of each pair in relatively close proximity increases the strength and tenacity of the fabric by balancing the stresses between the two sets of threads. Tests on a number of fabrics embodying the invention indicate improvements on a strength per unit weight ratio basis of between about 12and 20% depending upon the precise construction.

Although the principles and concepts of the present invention can be embodied in a large number of specific fabrics, some examples of which will be described in more detail below, the art well recognizes many of the limitations inherent in knitting machines. For example, there must be sufficient time to permit delivery of long and short lay-ins without distorting the fabric and thus inherently reducing its strength. Moreover, the invention is obviously inapplicable to fabrics that inherently involve equal yarn consumption in two or more bars, and in which the bars are equally aggressive. Those skilled in the art, with the guidance and examples given herein, will be able to create many fabrics that can be made more economically and will have greater strength than presently known fabrics.

For a better understanding of the invention, reference may be made to the following description of exemplary embodimens, two of which are shown in the accompanying drawings.

DESCRIPTION OF EXEMPLARY EMBODIMENTS

Figure 1:
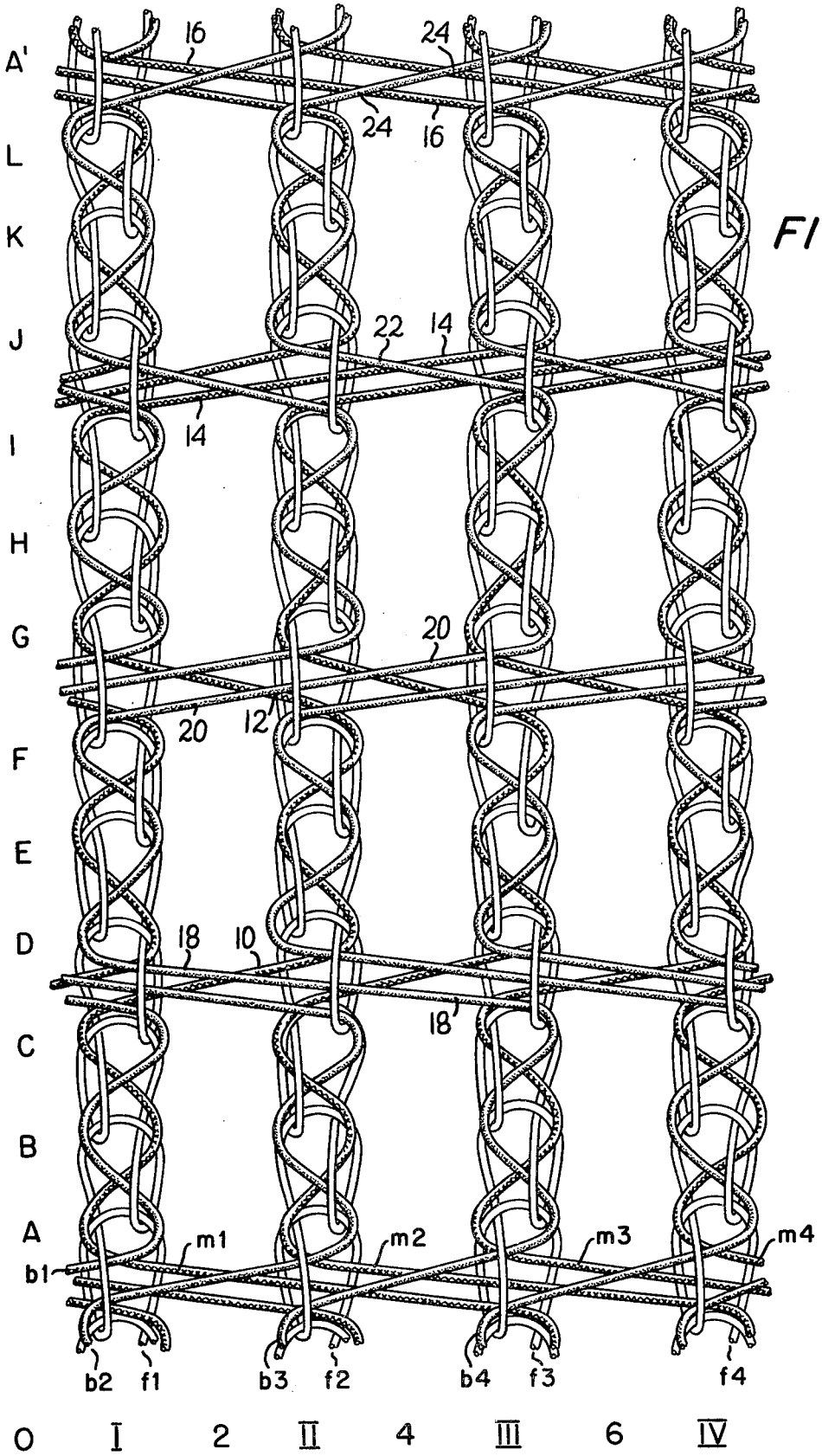
FIG. 1 illustrates the back of an open-mesh warp-knitted fabric embodying the invention.
Figure 2:
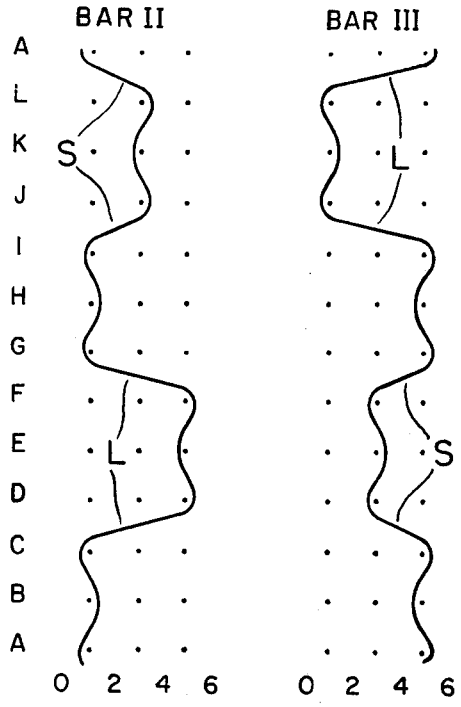
FIG. 2 is a dot diagram showing from the front the laid-in threads of the fabric shown in FIG. 1.

In FIGS. 1 and 2, which show a three-bar Rachel fabric in which the three guide bars are set up, at least with respect to two of the guide bars, to provide a three wale, twelve course repeat, the courses are labelled by letters A to L to the left of the illustration and the wales are numbered by Roman numerals I to IV below the drawing. The Arabic numerals 2, 4, 6 and 0 at the bottom of the drawing between wales designate in a well-known manner guide bar positions and are helpful in correlating the fabric construction to the machine formula. The formula for the fabric shown in FIG. 1 is as follows:

Guide Bar I, 20/02
Guide Bar II, 00/22/00/66/44/66/00/22/00/44/22/44
Guide Bar III, 66/44/66/22/44/22/66/44/66/00/22/00.

In the above formula, guide bar I (the front guide bar) forms contracted open loops in every course, each guide of guide bar I knitting solely on one needle on the needle bar. In the illustration of FIG. 1, the chain stitching threads delivered by guide bar I are labelled *f*1, *f*2, *f*3 and *f*4. Thus, guide bar I forms warp-wise continuous loops constituting warp-wise chain stitches, the lengths of which are indefinite and, of course, are determined by the thread capacity of the machine and the length of a given run.

Guide bar II, the middle guide bar in the machine set-up applicable to the fabric of FIG. 1, forms lay-ins in the knitted chains, each guide of guide bar II delivering a thread *m*1, *m*2, *m*3, or *m*4, respectively, to the underlaps of the chains formed by guide bar I. The threads *m*1, etc. delivered by guide bar II are lay-ins throughout the extent of the fabric, and each, of course, follows the same pattern, as follows, with particular reference to thread *m*1 which begins as a lay-in in course A of wale I: the thread *m*1 forms a lay-in in courses B and C of wale I, forms a lay-in across wales I and II in course D, forms a lay-in in courses E and F of wale II, forms a lay-in in course G from wale II to wale I, forms lay-ins in courses H and 1 of wale I, forms a lay-in in course J from wale I to wale III and forms lay-ins in courses K and L of wale III. Thread ml (and all other threads delivered by guide bar II) thus include the following lay-ins between wales in given courses in each repeat, which lay-ins extend in specific direction between particular pairs of wales: a short lay-in 10 extending from wale I to wale II in course D; a short lay-in 12 extending from wale II to wale I in course G; a long lay-in 14 extending from wale I to wale III in course J and a long lay-in 16 extending from wale III to wale I in course A'.

Each thread *b*1, *b*2, *b*3 and *b*4 delivered from guide bar III (the back guide bar in the machine set-up) follows a pattern that is the mirror image of the patterns of the threads *m*1 to *m*4 delivered by guide bar II offset by four courses from the pattern of the threads *m*1 to *m*4. Following the course of thread *b*3, which in the illustration is paired with the thread *m*1, thread *b*3 lays in in courses B and c of wale III, lays in in course D from wale III to wale I, lays in in courses E and F of wale I, lays in in course G from wale I to wale III, lays in in courses H and I of wale III, lays in in course J from wale III to wale II, lays in from courses K and L of wale II and lays in in course A' from wale II to wale III. The thread *b*3 from guide bar III thus includes long lay-in between wales 18 from wale III to wale I in course D and 20 in course G from wale I to wale III and short lay-in between wales 22 in course J from wale III to wale II and 24 in course A' from wale II to wale III.

All lay-ins between wales of the two sets of laid-in threads occur in the same courses, D, G, J and A', and in any given course in which there are lay-ins between wales, the direction in which the thread from one guide bar crosses is opposite from the direction in which the thread in that course from the other guide bar crosses. When the thread from one guide bar crosses in a given course between two wales, the thread from the other guide bar crossing in that course crosses between three wales.

To state the principle more generally, one thread of each of laid-in threads lays in a given course in one direction between a first number of wales and is matched by a lay-in of the other thread of the pair crossing in the opposite direction in that course between a different number of wales. Each lay-in between wales of each pair is alternately long in that it crosses a greater number of wales in two adjacent or nearby courses, first in one direction and then the other and is then short in that it crosses between a lesser number of wales, first in one direction and then the other in adjacent or nearby courses. When one lay-in between wales of each pair is long in the fabric, meaning that it moves across a greater number of wales, the other thread is short, in that it moves across a lesser number of wales. In the fabric of FIG. 1, the lay-ins 14 and 16 of thread ml are long and are matched by short lay-ins 22 and 24 of thread *b*3. Similarly, lay-ins 18 and 20 of thread *b*3 are long and are matched by short lay-ins 10 and 12 of thread *m*1. In each instance, each long lay-in moving between wales in one direction is matched by a short lay-in of the other thread of the pair moving between a lesser number of wales in the opposite direction.

As mentioned previously, the principles described above and exemplified in the fabric shown in the drawing can readily be applied to other warp-knitted fabrics, some of which may be half-gauge. In any case, at least two guide bars are laying in alternately aggressively and recessively (between different numbers of wales). Many fabrics may be expanded in either the warp-wise or course-wise direction by making lay-in movements of the guide bars across greater numbers of wales and between different courses. As used herein, the term "course" is used in a very general sense with the contemplation that laying in movement between wales may take place in a course, between adjacent courses or between spacedapart courses; in other words, by expanding the pattern of the guide bars in the wale-wise direction.

Figure 3:
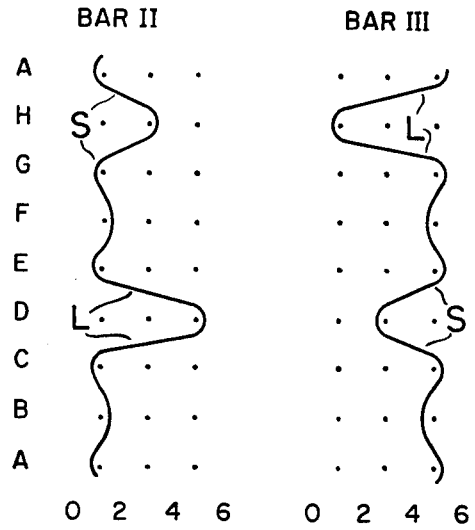
FIG. 3 is a dot diagram showing from the front the laid-in threads of another embodiment of the invention.
Figure 4:
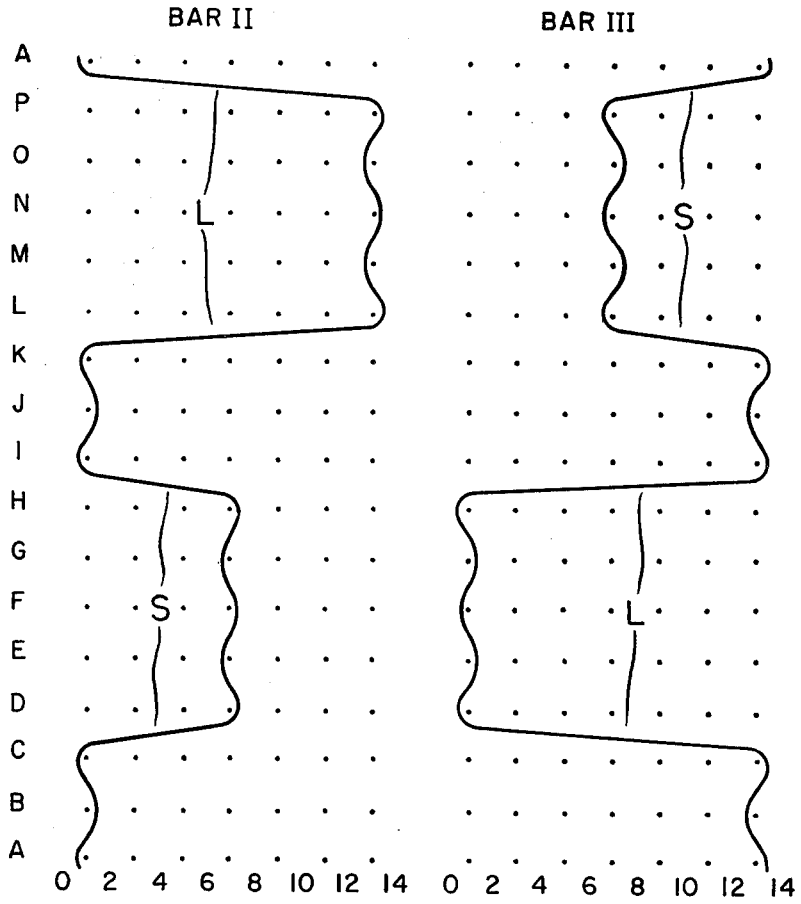
FIG. 4 is a dot diagram showing from the front the laid-in threads of still another embodiment.

Some additional examples of fabrics embodying the invention will be understood on the basis of the following formulae by which they are made and by reference to FIGS. 3 and 4 of the drawings. In FIGS. 2, 3 and 4, the long crossing thread sections are designated by the letter "L" and the short crossing thread sections by the letter "S".

An open-mesh fabric made on a Rachel machine by the following formula (see FIG. 3):

Guide Bar I, 02/20
Guide Bar II, 00/22/00/66/00/22/00/44
Guide Bar III, 66/44/66/22/66/44/66/00.

The above-described fabric and the fabric shown in the drawing are made using straight threading of the guides of the machine. The following fabric (see FIG. 4) requires 2 in 1 out threading and is another open-mesh fabric:

Guide Bar I, 02/20
Guide Bar II, 00/22/00/88/66/88/66/88/00/22/00/1414/1212/1414/1212/1414
Guide Bar III, 1414/1212/1414/00/22/00/22/00 1414/1212/1414/66/88/66/88/66

I claim:

1. A warp-knitted fabric having a multiplicity of threads forming a multiplicity of wales and courses comprising a set of threads forming a multiplicity of interconnected contracted loops and two sets of laid-in threads arranged in pairs, each of the threads of said pairs including in each repeat of a knitting pattern at least two short lay-ins between wales and at least two long lay-ins between wales, there being for each long lay-in between wales of each thread of each pair a corresponding short lay-in between wales of the other thread of the pair which is located in the same course as and extends in the opposite direction from the said long lay-ins between wales, and the threads of each pair being mirror images of each other offset from each other by at least two courses and thus being of substantially equal total length in each repeat.

2. A warp-knitted fabric according to claim 1 wherein each laid-in thread of each pair further includes in each repeat at least two lay-ins in a wale, there being for each lay-in in a wale of one of the threads of each pair of corresponding lay-in in a wale of the other thread of the pair located in the same courses.

3. A warp-knitted fabric according to claim 1 wherein each thread of the set which forms a multiplicity of interconnected loops forms warp-wise chain stitches comprising loops in every course in a wale and laps extending from course to course in that wale.

4. A warp-knitted fabric according to claim 2 wherein each thread of the set which forms a multiplicity of interconnected loops forms warp-wise chain stitches comprising loops in every course in a wale and laps extending from course to course in that wale.

* * * * *

UNITED STATES PATENT AND TRADEMARK OFFICE

CERTIFICATE OF CORRECTION

PATENT NO. : 4,044,576

DATED : Aug. 30, 1977

INVENTOR(S) : Milton Kurz

It is certified that error appears in the above-identified patent and that said Letters Patent are hereby corrected as shown below:

Col. 1, line 27, "delivererd" should be --delivered--;
Col. 1, line 39, "fabrics," should be --fabric,--;
Col. 1, line 67, "other," should be --others,--;
Col. 2, line 29, "termns" should be --terms-- and "'short'" should be --"short,"--;
Col. 2, line 32, after "thus," insert --a--;
Col. 2, line 50, "oppostie" should be --opposite--;
Col. 3, line 3, "12and" should be --12% and--;
Col. 3, line 22, "embodimens," should be --embodiments,--
Col. 4, line 28, "B and c" should be --B and C--;
Col. 4, line 34, "lay-in" should be --lay-ins--;
Col. 4, line 37, "lay-in" should be --lay-ins--;
Col. 4, line 50, after "each" insert --pair--; and
Col. 6, line 25, "pair of" should be --pair a--.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*